US007380288B1

(12) United States Patent
Duncan

(10) Patent No.: US 7,380,288 B1
(45) Date of Patent: Jun. 3, 2008

(54) HAND MITT WITH SEALED SEAMS

(76) Inventor: David Duncan, P. O. Box 802882, Santa Clarita, CA (US) 91380-2882

( * ) Notice: Subject to any disclaimer, the term of this patent is extended or adjusted under 35 U.S.C. 154(b) by 0 days.

(21) Appl. No.: 11/092,173

(22) Filed: Mar. 29, 2005

Related U.S. Application Data

(60) Provisional application No. 60/557,122, filed on Mar. 29, 2004.

(51) Int. Cl.
*A41D 19/00* (2006.01)

(52) U.S. Cl. ..... 2/161.6; 2/167; 2/168

(58) Field of Classification Search ..... 2/158, 2/159, 161.6, 161.8, 16, 164, 167, 168; 15/227
See application file for complete search history.

(56) References Cited

U.S. PATENT DOCUMENTS

| | | | | |
|---|---|---|---|---|
| 580,148 | A | 4/1897 | Staples | |
| 1,714,648 | A | 5/1929 | Walker | |
| 1,736,209 | A | 11/1929 | Millard | |
| 1,941,320 | A | 12/1933 | Pamplin | |
| 2,040,137 | A | 5/1936 | Jensen | |
| 2,128,796 | A | 8/1938 | Bohm-Mayo | |
| 2,261,064 | A | 10/1941 | Katz | |
| 2,274,605 | A | 2/1942 | Hoffmeister | |
| 2,304,137 | A * | 12/1942 | Peakes | 2/168 |
| 2,306,062 | A | 12/1942 | Katz | |
| 2,357,574 | A | 9/1944 | Beebe | |
| 2,462,787 | A * | 2/1949 | Steinberg | 2/161.8 |
| 2,571,228 | A | 10/1951 | Freeman | |
| 2,619,672 | A | 12/1952 | Glaser | |
| 2,810,131 | A | 10/1957 | Kogut | |
| 2,905,946 | A | 3/1959 | Goldsmith | |
| 2,884,644 | A | 5/1959 | Jefferson | |
| 3,535,708 | A | 10/1970 | Alpert | |
| 4,071,921 | A | 2/1978 | Jury | |
| 4,262,385 | A | 4/1981 | Norman | |
| 4,330,887 | A | 5/1982 | White | |
| 4,523,348 | A | 6/1985 | Petrie | |
| 4,583,248 | A | 4/1986 | Edwards | |
| 4,645,251 | A | 2/1987 | Jacobs | |
| 4,654,896 | A * | 4/1987 | Rinehart | 2/163 |
| 4,733,413 | A * | 3/1988 | Dykstra | 2/169 |
| 4,779,289 | A | 10/1988 | Prouty | |
| 4,930,543 | A | 6/1990 | Zuiches | |
| 5,070,540 | A * | 12/1991 | Bettcher et al. | 2/2.5 |
| 5,469,601 | A | 11/1995 | Jackson | |
| 5,498,472 | A | 3/1996 | Gold | |
| 5,674,268 | A | 10/1997 | Riazi | |
| 5,678,249 | A | 10/1997 | Smith | |

(Continued)

FOREIGN PATENT DOCUMENTS

DE 29611356 U1 9/1996

*Primary Examiner*—Katherine Moran
*Assistant Examiner*—Sally C Cline

(57) ABSTRACT

A kitchen grip is composed of a water-proof and stain-proof material, having temperature control characteristics. A sheet having a smooth or textured and recessed imprint on one surface provides a non-slip contact surface, while the opposite surface of the sheet is composed of a close fabricated fabric affixed to the sheet of textured, non-slip contact surface material. The sheets are die cut to a useful shape. The two sheets are joined together by a zigzag lock or straight stitch employing nylon thread, by sonic welding or gluing.

14 Claims, 2 Drawing Sheets

U.S. PATENT DOCUMENTS 5,682,613 A * 11/1997 Dinatale ..... 2/168
D388,553 S 12/1997 Sapin
5,711,032 A 1/1998 Carpenter
5,891,116 A 4/1999 Mast
5,935,882 A 8/1999 Fujita
5,946,727 A 9/1999 Wright
5,956,770 A 9/1999 Dennis
6,240,565 B1 6/2001 Spear
6,298,488 B1 * 10/2001 Duncan et al. ..... 2/158
6,305,023 B1 10/2001 Barkes
6,385,817 B1 5/2002 Johnson
D464,176 S 10/2002 Cintron
6,671,931 B1 1/2004 Duncan
6,699,802 B1 3/2004 Hainsworth
6,931,666 B1 8/2005 Brady
D510,645 S 10/2005 Duncan
2005/0114983 A1 * 6/2005 Demay et al. ..... 2/160

* cited by examiner 10
15
16
17
11
18
12

23
24
22
20
21
25
15
11
12

16
10
4
4
27
25
26

20
21
25
11
12
27

HAND MITT WITH SEALED SEAMS

Priority Claimed on Ser. No. 60/557,122 filed Mar. 29, 2004 now abandoned.

BACKGROUND OF THE INVENTION

1. Field of the Invention

The present invention relates to multipurpose kitchen implements for supporting, holding or gripping a variety of hot or cold articles such as cooking pots, pans, lids, handles or the like.

2. Brief Description of the Prior Art

In the past, it has been the conventional practice to employ cloth mitts and/or potholders for protecting the hands of the user from burning when handling hot articles in the kitchen such as cooking pots, pans or the like. Also, fabric or other porous materials are currently being used for supporting heated articles in order to protect a table or counter surface. Such conventional kitchen implements are disclosed in U.S. Pat. Nos. 2,261,064; 3,535,708; 4,071,921 and 6,298,488.

Problems and difficulties have been encountered when using such conventional kitchen implements which stem largely from the fact that the articles are composed of cloth and are not water-repellant, stain resistant and lack temperature control. The prior kitchen implements permit liquids to penetrate straight through to the hand or fingers of the user when used as a mitt or potholder. Such penetration serves as a conductor for hot substances and transmits the heat directly to the user's hands. Furthermore, the liquid or substance stains the material and now must be treated and laundered. During the treatment and laundering procedure, the soiled mitt or potholder is out of service requiring the user to have backup implements. Even after laundering, conventional mitts, potholders and trivets remain permanently stained. Furthermore, prior kitchen mitts or potholders rely on tight stitching to join edge marginal regions of the implements together to effectively close and seal the edges. Although nylon filaments are used, the stitching may be over-tightened which tears, weakens or rips the foam material through which the stitching is embedded. Any tear in the surface of such material causes fatigue of the mitt and allows moisture or harmful liquid to pass through.

Therefore, a long-standing need has existed to provide kitchen implements for protecting the hands and fingers of a cook or other person from injury due to excessive hot or cold temperatures and to provide such implements which are composed of water-proof and stain-resistant materials. Also, it is preferred that the seams and edge closures be made water-repellant, stain and water-resistant, and provide a tight seal for any stitching.

SUMMARY OF THE INVENTION

Accordingly, the above problems and difficulties are avoided by the present invention which provides a novel kitchen grip or implement for kitchen use which is composed of a water-resistant and stain-proof material, having temperature control characteristics. Such a material forms the implement from a sheet having a textured, recessed imprint on one surface providing a nonslip contact surface, while the opposite surface of the sheet is composed of a close fabricated fabric which is affixed to the sheet of textured, non-slip contact surface material. The fabric sheet may be a sheet of nylon/polyester composition which is affixed to the non-slip contact surface sheet which may be composed of a chloride rubber or other materials, such as silicone, Teflon, etc. The sheets are then die cut to the shape of a useful implement such as a hand mitt, a trivet, a lid holder or the like. A two-piece implement such as a hand mitt requires that two pieces of the fabric and chloride rubber sheets be joined together by means of a zigzag lock or straight stitch employing nylon thread or by sonic welding, gluing or the like. Therefore, one surface of the mitt may include a cross-cut textured recessed imprint providing a non-slip or gripping contact surface while the opposite exposed surface of the mitt may take the form of the smooth nylon/polyester fabric. The gripping or chloride rubber neoprene sheet serves as a very efficient hot and cold temperature insulator for the user's hands and fingers and the surface of the chloride rubber neoprene sheet resists impregnation by stains and other damaging compositions and such surface is easily washed when rinsed under water. Also, it is noted that the sheet of nylon polyester fabric is water and stain resistant as well which characteristics are greatly augmented when attached or carried on the sheet of chloride rubber neoprene.

A feature resides using the nylon stitching along edge marginal regions so that the terminating edges of the polyester fabric or exposed rubber material define a channel between the opposing surfaces thereof which is filled with a protective barrier creating a water and liquid proof coating.

Therefore, it is among the primary objects of the present invention to provide a novel kitchen implement which may take the form of a potholder, trivet or mitt which has a composition characterized as being water-proof, stain resistant and which includes temperature control characteristics for the protection of the user.

Another object of the present invention is to provide such kitchen implements which are intended to work with cast iron, aluminum, stainless steel or plastic microwave cookware and which is intended to be used with hot articles or articles subject to sub-zero or refrigerator freezer temperatures.

Still a further object of the present invention is to provide a multipurpose kitchen implement which is composed of a sheet of flexible material having a surface which is smooth composed of a layer of nylon/polyester fabric affixed to a layer of chloride rubber neoprene which may then be die-cut to the shape of a desired implement resulting in a one or two-piece implement that is water-resistant and protects the hands and fingers of the user from hot and cold liquids or surface contacts.

Still a further object of the present invention is to provide a novel multipurpose kitchen implement that includes material which is water-repellent, water-proof, and stainproof and which further provides temperature control and protection for the user and which provides a positive gripping contact allowing the user to securely grasp either hot articles or frozen articles without fear of the article slipping from the hand.

A further object resides in providing a potholder, hot pad or other kitchen implement which includes a surface having a high coefficient of friction so as to provide a positive gripping action by a person holding a hot or cold item with the implement.

An important feature resides in a mitt or kitchen glove having a protective barrier covering all seams, joints or closures against contact with liquids, water or stains.

Another object resides in water or liquid proofing of seams joining layers of fabric material.

DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
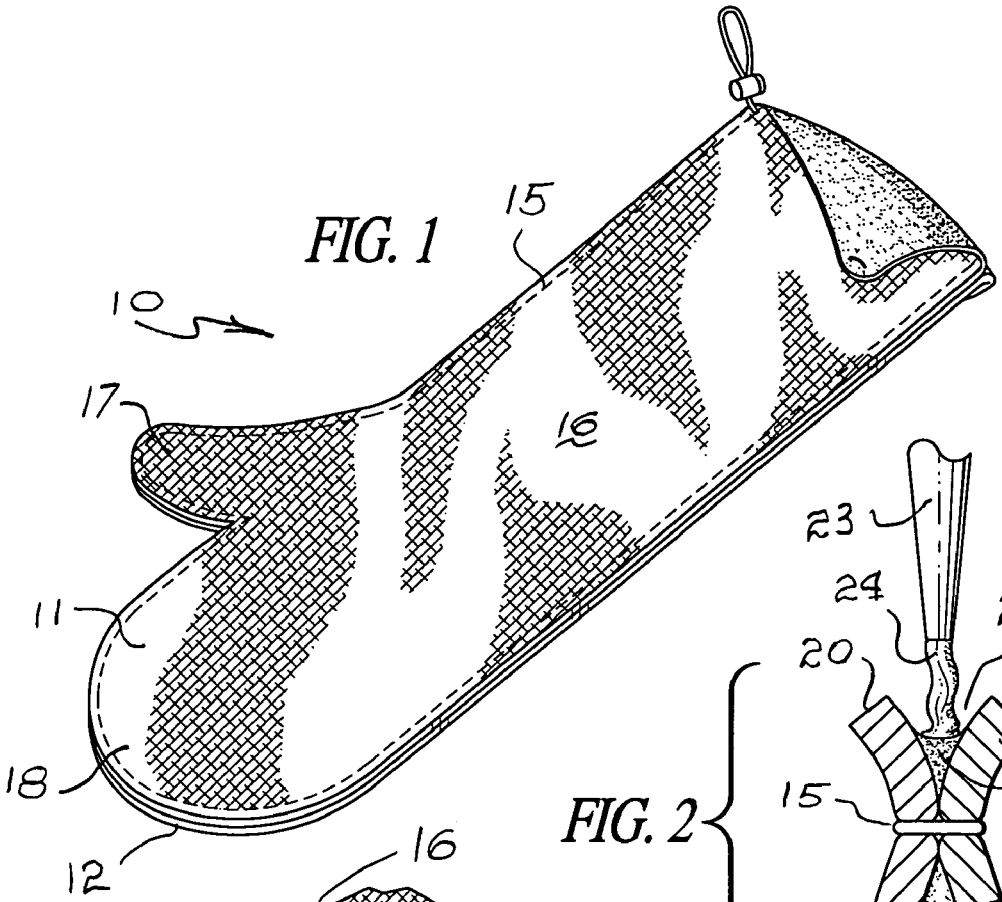
FIG. 1 is a perspective view showing a kitchen implement taking the form of a hand mitt preparatory to incorporating the present invention.

Referring to FIG. 1, an example of a novel kitchen implement or aid is illustrated in the general direction of arrow 10 which takes the form of a mitt intended to be worn when handling extremely hot or cold articles. The mitt 10 includes a top sheet 11 and an under or opposite sheet 12, wherein the sheet 11 includes an irregular surface indicated by numeral 16 and is intended to correspond with the palm of the user when the mitt is on the right hand. The top and bottom sheets 11 and 12 are composed of a sheet or layer of nylon/polyester fabric and a layer of a chloride rubber (neoprene) composition. The layers are suitably affixed to one another to provide each of the respective sheets in accordance with conventional practice. When the sheets are die-cut to a particular shape, such as that of a hand mitt, the two die-cut sections comprise a top and bottom section having their peripheral edges attached together, such as by a stitch, representing a lock stitch as shown by numeral 15. The sewing compresses the peripheral edge marginal regions of the respective sheets so as to create a water-resistant seam to protect the hands of the wearer from hot or cold liquids or adverse effects of liquid stains. The respective sheets 11 and 12 are provided with an irregular surface, such as the waffle surface indicated by numeral 16. An example of such a mitt is disclosed in U.S. Letters Patent, U.S. Pat. No. 6,298,488 and the disclosure therein is incorporated into the present disclosure by reference.

It can be seen that the die-cut sheets of material include an outwardly projecting portion 17 for insertably receiving the thumb of the user while a rounded frontal portion 18 of the mitt is employed for insertably receiving the fingers of the user. The kitchen mitt 10 is illustrated as being untreated on its exterior surface and preparatory for being treated with a protective barrier compound.

Figure 2:
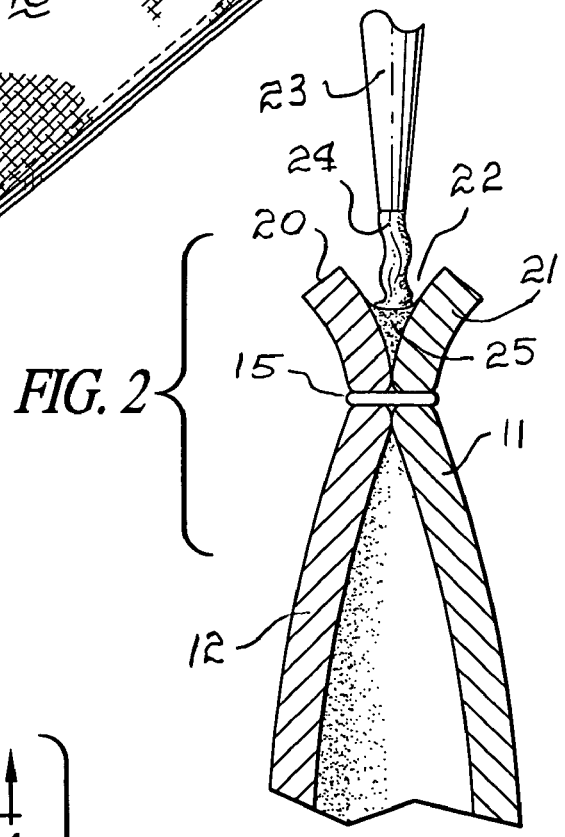
FIG. 2 is an enlarged cross-sectional view of the oven mitt shown in FIG. 1 illustrating a joint or seam in the process of receiving a protective barrier.

In FIG. 2, the edge marginal regions of sheets 11 and 12 are secured together by the stitch 15 which may take the form of any suitable thread, filament or cord. In applying the stitching, the material of the fabric layers 11 and 12 are compressed together so as to provide a water-resistant closure. However, the distal ends or edge marginal regions of the sheets or layers, identified by numeral 20 and 21, have a tendency to outwardly flare in opposite directions when so compressed so as to provide an open channel 22 between the opposite surfaces of the layers. One means of providing a protective barrier against liquids, stains or water, is to employ a nozzle 23 for discharging a compound or material which will effect a protective coating within the channel 22 and such a material is identified by numeral 24. A buildup of the material is indicated by numeral 25 which is permitted to cure and adheres to the adjacent surfaces of the layers 11 and 12 at their distal ends 20 and 21.

Figure 3:
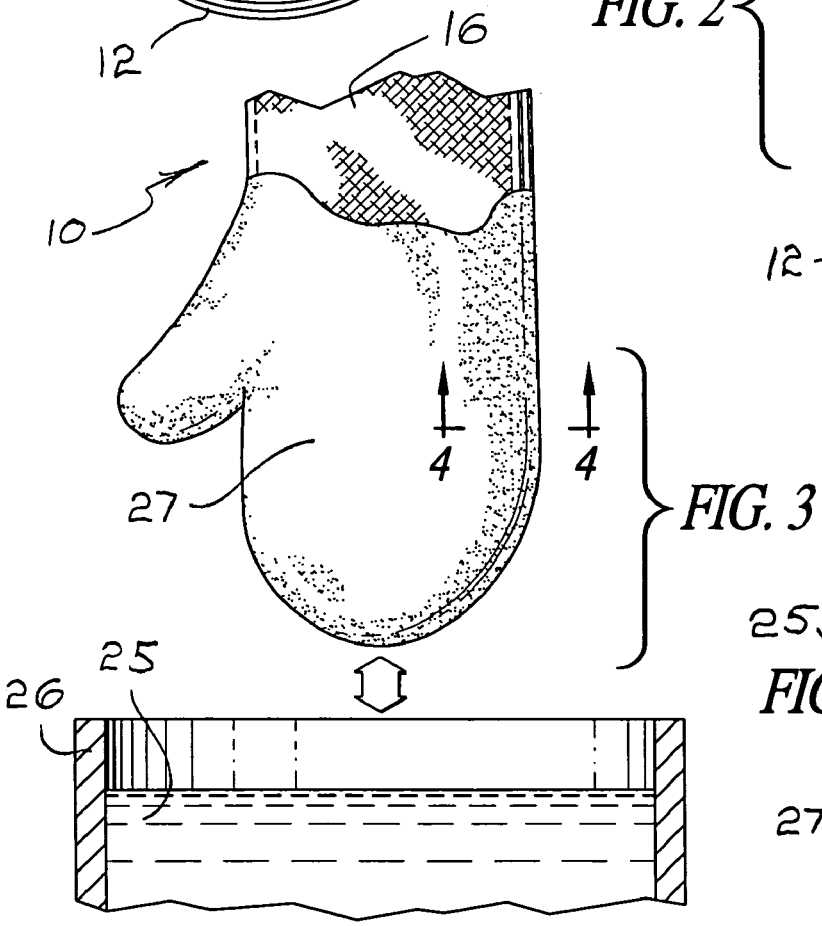
FIG. 3 is an exploded view illustrating further processing by coating the external surface of a kitchen mitt as well as all seams and joints with a liquid or water protective barrier.

Another or further step in providing a protective barrier at the seams is illustrated in FIG. 3 wherein subsequent to application of material 24 into the channel 22, the mitt 10 is introduced into a protective liquid 25 contained within a vat 26. The surface 16 of the mitt 10 is coated with the protective liquid 25 contained within vat 26. As the mitt is withdrawn from the vat, the material 25 will cling to the exterior surface of the mitt and such a coating is indicated by numeral 27 and becomes the external surface of the mitt totally covering surface 16.

Figure 4:
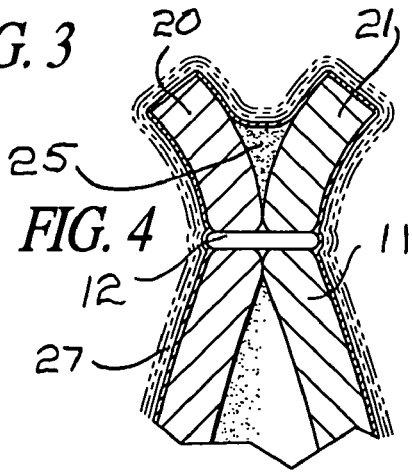
FIG. 4 is a view, similar to the view of FIG. 2, showing a cured protective barrier adjacent to a seam, as taken in the direction of arrows 4-4 of FIG. 3.

As shown in FIG. 4, the coating 27 not only covers the external surface of the mitt but also adds to and covers the deposit material 25 previously introduced by the nozzle 23. Therefore, it can be seen that a double protective layer is provided around the total periphery of the mitt 10. Not only is the initial material 25 covered by a second coating 27, but the area about the stitching 12 is also covered by the coating 27.

The protective material 24/25 is a liquid neoprene or silicone or the like and the mitt 10 may be dipped or introduced into the vat once, twice or three times in order to obtain a heavier or thicker formula. Subsequently, the mitt with the coating is permitted to air-dry or may be placed into an oven to bake at normal oven temperatures until cured. The result is a mitt with a protective barrier over the entire outer external surface which creates a water and liquid barrier-proof coating. Furthermore, additional sealing of the edges may be obtained by using a urethane adhesive and sealant containing some or measured portions of toluene.

Figure 5:
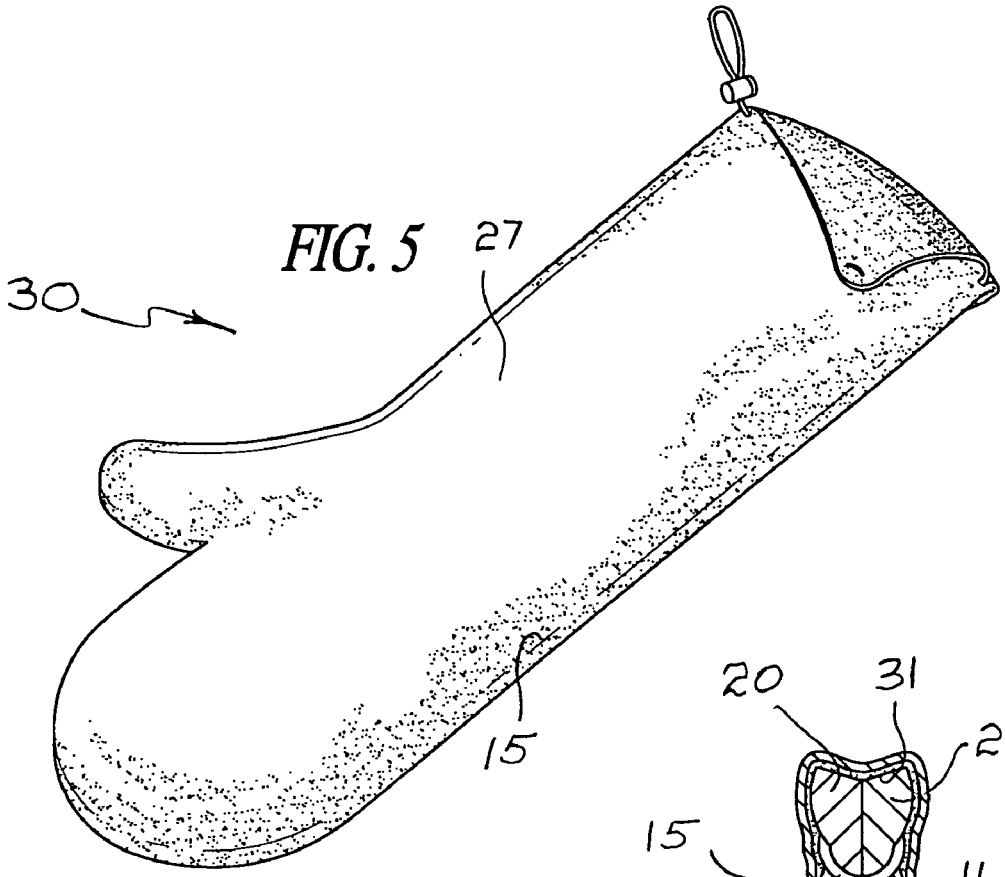
FIG. 5 is a view of a kitchen mitt completely coated with a protective barrier subsequent to the process shown in FIG. 3.

Referring now in detail to FIG. 5, a fully protected mitt is illustrated in the general direction of arrow 30 and it can be seen that the entire outer surface of the mitt is covered with the coating 27 which also includes covering of the stitching 15.

Figure 6:
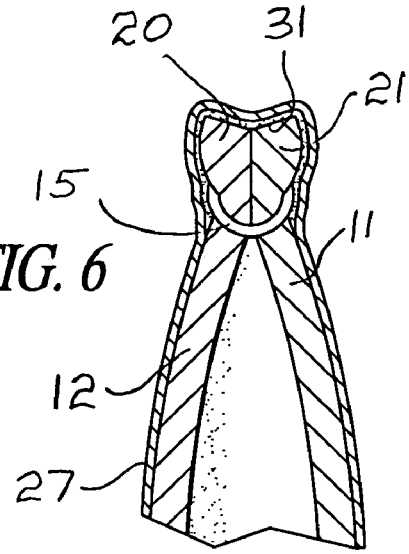
FIG. 6 is an enlarged sectional view of an external seam in the kitchen mitt of FIG. 5 covered with a protective barrier.

In FIG. 6, the stitching 15 is of a different style than that shown in FIGS. 3 and 4 and the stitching draws the terminal or distal edge marginal regions 20 and 21 together so that the opposing surfaces are engaged. In this instance, the nozzle 23 is employed to deposit or discharge material 24 around the external surface of the joint created by stitching 15 and such an initial coating or layer of material is indicated by numeral 31. Next, the mitt is introduced into the vat of material 25 so that the entire surface of the mitt is covered which also includes the material 31 on the external surface of the joint.

Figure 7:
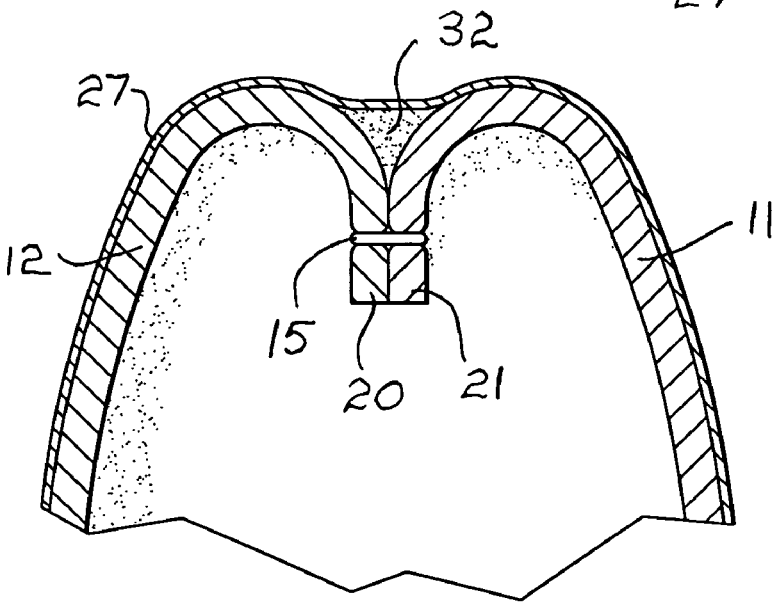
FIG. 7 is an enlarged sectional view of an internal seam or joint covered with a protective barrier.

Referring now to FIG. 7, it can be seen that when the edge marginal regions 20 and 21 of the sheets or layers 11 and 12 are folded inwardly with stitch 15 joining the distal ends together, a protective barrier is deposited between the outer surfaces of the layers and is represented by numeral 32. Once the material 32 has been placed by nozzle 23, the material is permitted to cure which not only seals the stitching 15 but also bond the external surfaces of the sheets together at this location. Next, the mitt is introduced into the vat 26 and the material 25 is deposited around the external surface of the mitt to provide a water-proof and stain-resistant coating 27.

In view of the foregoing, it can be seen that the mitt is thoroughly coated about the seams running along the peripheral edge of the mitt and that an overall coating is applied to the exterior surface to seal and provide a protective barrier against water, moisture, stains or any other liquid. By this means, the stitching 15 is thoroughly protected and covered and any stress placed on the sheets 11 and 12 will not cause openings between stitches that would normally result in leaks. The exterior coating and sealant may be of any substance, such as chloride rubber, silicone, Teflon, plastic, etc. The mitt surface may be smooth or textured.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A multipurpose non-disposable kitchen mitt for protection from liquids, heat, cold and staining comprising:

a pair of sheets of flexible material wherein each sheet is composed of a first layer of fabric and a second layer composed of chloride rubber;

said first layer and said second layer having opposing surfaces affixed together and a common edge peripheral region defined by an edge termination of said respective first and said second layers;

said first layer and said second layer characterized as water resistant, stain resistant and insulative to heat and cold temperatures;

means located at said common edge peripheral region compressing said edge termination for forming a seam and defining a channel proximate and outward of said seam and between said opposing surfaces of said first and second layers;

a protective barrier disposed in said channel adhering to said opposing surfaces of said first and second layers to provide waterproof protection for said channel and seam;

the pair of said sheets having identical composition and having coextensive common edge marginal regions and edge terminations; and a protective coating carried on an exterior surface of said pair of sheets and disposed partially in said channel over said protective barrier.

2. The kitchen mitt defined in claim 1 wherein:

said second layer has an irregular exterior surface chosen from:

a. raised ribs;

b. recesses; or c. raised waffle-type pattern.

3. The kitchen mitt defined in claim 1 wherein the chloride rubber is polychloroprene.

4. The kitchen mitt defined in claim 1:

wherein the protective barrier is part of an external coating of waterproof material covering said pair of sheets and said edge marginal regions.

5. The kitchen mitt defined in claim 1:

wherein the first layer of fabric comprises a nylon/polyester material.

6. The kitchen mitt defined in claim 1:

wherein the means for forming a seam comprises stitching.

7. The kitchen mitt defined in claim 1 wherein:

said edge termination of said first and second layers are folded towards each other with their periphery directed into the mitt toward the means located at said common edge peripheral region compressing said edge termination for forming a seam.

8. A multipurpose kitchen mitt for protection from liquids, heat, cold and staining comprising:

a pair of sheets of flexible material wherein each sheet is composed of a first layer of fabric and a second layer composed of chloride rubber;

said first layer and said second layer having opposing surfaces affixed together and a common edge peripheral region defined by an edge termination of said respective first and said second layers;

said first layer and said second layer characterized as water resistant, stain resistant and insulative to heat and cold temperatures;

means located at said common edge peripheral region compressing said edge termination for forming a seam and defining a channel proximate and outward of said seam and between said opposing surfaces of said first and second layers;

a protective barrier disposed in said channel adhering to said opposing surfaces of said first and second layers to provide waterproof protection for said channel and seam; and a protective coating carried on an exterior surface of said pair of sheets and disposed partially in said channel over said protective barrier.

9. The kitchen mitt defined in claim 8 wherein:

said second layer has an irregular exterior surface chosen from raised ribs; recesses; or raised waffle-type pattern.

10. The kitchen mitt defined in claim 8 wherein the chloride rubber is polychloroprene.

11. The kitchen mitt defined in claim 8:

wherein the protective barrier is part of an external coating of waterproof material covering said pair of sheets and said edge marginal regions.

12. The kitchen mitt defined in claim 8:

wherein the first layer of fabric comprises a nylon/polyester material.

13. The kitchen mitt defined in claim 8:

wherein the means for forming a seam comprises stitching.

14. The kitchen mitt defined in claim 8 wherein:

said edge termination of said first and second layers are folded towards each other with their periphery directed into the mitt toward the means located at said common edge peripheral region compressing said edge termination for forming a seam.

* * * * *